US005174267A

United States Patent [19]

DeBiasi

[11] Patent Number: 5,174,267

[45] Date of Patent: Dec. 29, 1992

[54] CYLINDER IDENTIFICATION BY SPARK DISCHARGE ANALYSIS FOR INTERNAL COMBUSTION ENGINES

[75] Inventor: Charles J. DeBiasi, Allen Park, Mich.

[73] Assignee: Ford Motor Company, Dearborn, Mich.

[21] Appl. No.: 734,377

[22] Filed: Jul. 22, 1991

[51] Int. Cl.[5] ..... F02P 17/00

[52] U.S. Cl. ..... 123/643; 123/644; 324/379

[58] Field of Search ..... 123/414, 609, 643, 644; 73/116, 117.3; 324/378, 380, 391, 379

[56] References Cited

U.S. PATENT DOCUMENTS

| | | | |
|---|---|---|---|
| 4,055,079 | 10/1977 | Dudziak | 73/117.3 |
| 4,356,447 | 10/1982 | Hönig et al. | 324/169 |
| 4,459,544 | 7/1984 | Makita | 324/391 |
| 4,708,121 | 11/1987 | Everett et al. | 123/643 |
| 4,711,227 | 12/1987 | Li et al. | 123/643 |
| 4,742,306 | 5/1988 | Everett et al. | 324/379 |
| 4,795,979 | 1/1989 | Kreft et al. | 324/379 |
| 4,889,094 | 12/1989 | Beyer et al. | 123/414 |
| 4,913,123 | 4/1990 | DeBiasi et al. | 123/609 |
| 4,993,861 | 6/1990 | Allen et al. | 364/431.04 |
| 5,046,470 | 9/1991 | Entermann et al. | 123/481 |
| 5,065,729 | 11/1991 | Krauter et al. | 123/643 |
| 5,067,462 | 11/1991 | Iwata et al. | 123/643 X |

*Primary Examiner*—Tony M. Argenbright
*Attorney, Agent, or Firm*—Roger May; Peter Abolins

[57] ABSTRACT

Spark discharge signals monitored on primary windings of ignition coils of a coil per plug (CPP) ignition system are used to identify which cylinder of a cylinder pair is in compression and which cylinder in a cylinder pair is in exhaust. Once determined, the cylinder pair can be tracked such that the primary windings do not need to be monitored further. In one embodiment of the invention, the duration times of substantially simultaneous spark discharge signals in cylinders of a pair of cylinders are compared to one another. The shorter duration time signal indicates the cylinder in the compression cycle. One cylinder pair may be tested two or more times or one or more additional cylinder pairs may be tested to verify cylinder identification. In a second embodiment of the invention, two or more spark dwell signals are applied to the primary windings of the ignition coils for each spark event of a pair of cylinders. The time periods required for the second dwell signals to produce current flows in the primary windings equal to a predetermined current value is determined for each of the cylinders. The time preiods are then compared to one another with the shorter time period indicating the cylinder in exhaust.

16 Claims, 4 Drawing Sheets

CYLINDER IDENTIFICATION BY SPARK DISCHARGE ANALYSIS FOR INTERNAL COMBUSTION ENGINES

CROSS REFERENCE TO RESTED APPLICATION

The present application is related to application Ser. No. 07/723,475 which is entitled Short Circuited Secondary Detection Via Primary Monitoring which was filed by the inventor of the present application on Jun. 28, 1991 and assigned to the same assignee.

BACKGROUND OF THE INVENTION

The present invention relates generally to internal combustion engine ignition systems and, more particularly, to a method and apparatus for identifying the cylinder in compression of a cylinder pair of an internal combustion engine having an even number of cylinders and a coil per plug (CPP) ignition system wherein each cylinder has an associated coil having a primary winding and a secondary winding which is connected to a spark producing device or spark plug operable to fire the cylinder.

Ever stricter emission control standards and fuel economy requirements demand precise control of internal combustion engines, particularly control of ignition and fuel injection systems. Engine control can be coupled to cylinder pairs in engines having an even number of cylinders with cylinder pairs being identified by a crankshaft position sensor and crankshaft mounted timing wheel. For more precise control, engine control systems must recognize the compression stroke of one of the cylinders of the engine, typically the number one cylinder. In the past, identification of the cylinders has been performed by a cylinder identification (CID) sensor which responds to indicia on a camshaft of the engine.

While a CID sensor could be used to provide both cylinder identification and engine position, unfortunately CID sensor determinations are not sufficiently accurate due to mechanical play in the gear trains or belts which drive the camshaft. To provide sufficient accuracy, the CID sensor is used in combination with a crankshaft position sensor and crankshaft mounted timing wheel. Due to the inaccuracies of the CID sensor leading to its inability to function independently of a crankshaft sensor, it would be desirable to be able to perform cylinder identification without the CID sensor such that the CID sensor and related expense could be eliminated.

To that end, U.S. Pat. No. 4,889,094 describes a method of recognizing the power stroke of an internal combustion engine by comparing a first signal that is synchronized with the crankshaft angle and a second signal that is modulated by the combustion events of the engine. By combining the first and second signals, a third signal identifying the first cylinder in an internal combustion engine having an odd number of cylinders is generated. Unfortunately, the described method is not applicable to an engine having an even number of cylinders.

There is thus a need for the identification of cylinders in internal combustion engines having an even number of cylinders which does not rely on a CID sensor.

SUMMARY OF THE INVENTION

This need is met by the method and apparatus of the present invention wherein spark discharge signals monitored on the primary windings of ignition coils of a coil per plug (CPP) ignition system are used to identify which cylinder of a cylinder pair is in compression and which cylinder of a cylinder pair is in exhaust. Once determined, the cylinder pair can be tracked such that the monitoring and identification operations can be discontinued. Applicant has determined that the duration of spark discharge signals is extended for a cylinder in the exhaust cycle relative to the same cylinder in the compression cycle. Accordingly, in one embodiment of the invention, the duration times of the spark discharge signals in the cylinders of a pair of cylinders which are substantially simultaneously fired are compared to one another. The cylinder having the longer duration time spark discharge signal is then indicated as being in the exhaust cycle and the cylinder with the shorter duration time spark discharge signal is indicated as being in the compression cycle. One cylinder pair may be tested two or more times or all cylinder pairs may be tested one or more times to verify the results of the cylinder identification process. Due to the high signal amplitude and poor quality of coil primary voltage signals, a second embodiment of the invention is presently preferred.

In the second embodiment, two or more spark dwell signals are applied to the primary windings of the ignition coils for each spark event of a pair of engine cylinders. The time periods required for the second dwell signals, for example, to produce current flows in the primary windings equal to a predetermined current value is determined for each of the cylinders in the pair of cylinders. The time periods for the cylinders of the cylinder pair are then compared to one another to determine which cylinder is in compression and which cylinder is in exhaust. The cylinder with the shorter time period is indicated as the cylinder in exhaust and the other cylinder is indicated as the cylinder in compression.

Operation of the second embodiment is based on the fact that for a cylinder in the exhaust cycle, the energy is withdrawn from the coil more slowly such that energy remains in the primary winding when the second dwell signal is applied thereto. Thus, the time required for the second dwell signal to raise the current level in the primary winding to the preselected level in the cylinder in exhaust is less than the time required for the second dwell signal to raise the current level in the primary winding to the preselected level in the cylinder in compression which must build current flow in its primary winding substantially from zero.

In accordance with one aspect of the present invention, a method of identifying a cylinder in compression of a cylinder pair in an internal combustion engine having an even number of cylinders and a coil per plug ignition system, each coil having a primary winding and a secondary winding with the secondary winding being connected to a spark producing device in a cylinder corresponding to the coil comprises the steps of: driving the primary windings of the coils of the pair of cylinders substantially simultaneously to generate spark discharge energy in the secondary windings of the coils; monitoring the primary windings for signals representative of spark discharge in spark producing devices connected to the secondary windings; and, analyzing spark discharge signals on the primary windings to identify which cylinder of the cylinder pair is in compression and which cylinder of the cylinder pair is in exhaust.

The method preferably further comprises the steps of: tracking the cylinder pair to maintain a record of which cylinder of the cylinder pair is in compression without further monitoring of the primary windings and analysis of the spark discharge signals; discontinuing driving the cylinder of the cylinder pair which is in exhaust; and, discontinuing analysis of the spark discharge signals. In this way, spark in the cylinder in exhaust is discontinued almost immediately upon engine start-up to prevent potential interference with engine operation and to improve vehicle electrical efficiency. Also, sequential fueling is enabled by use of a cylinder identification signal which is provided to a fuel controller.

In one embodiment, the step of analyzing spark discharge signals on the primary windings to identify which cylinder of the cylinder pair is in compression and which cylinder of the cylinder pair is in exhaust comprises the steps of: comparing the duration times of the spark discharge signals to one another; and, identifying a cylinder including the spark producing device which produced the shorter of the spark discharge signals as the cylinder of the cylinder pair which is in compression.

In an alternate preferred embodiment, the step of driving the primary windings to generate spark discharge energy in the secondary windings comprises the step of providing at least first and second drive signals to the primary windings for each spark event and the step of analyzing spark discharge signals on the primary windings to identify which cylinder of the cylinder pair is in compression and which cylinder of the cylinder pair is in exhaust comprises the steps of: stopping the second drive signals to the primary windings when current flowing in the primary windings reaches a preselected magnitude; determining time duration periods of the second drive signals to the primary windings; and, comparing the time duration periods of the second drive signals of the cylinder pair to one another. The method further comprises the step of indicating a cylinder having the longer time duration period for its second drive signal as the cylinder in compression of the cylinder pair.

Alternately, the step of analyzing spark discharge signals on the primary windings to identify which cylinder of the cylinder pair is in compression and which cylinder of the cylinder pair is in exhaust may comprise the steps of: determining time duration periods of the second drive signals required to produce current flow in the primary winding equal to a preselected magnitude; and, comparing the time duration periods of the second drive signals of the cylinder pair to one another. The method further comprises the step of indicating the cylinder having the longer time duration period of its second drive signal as the cylinder in compression of the cylinder pair.

In accordance with another aspect of the present invention, a method of identifying cylinders in compression of cylinder pairs in an internal combustion engine having an even number of cylinders and a coil per plug ignition system, each coil having a primary winding and a secondary winding with the secondary winding being connected to a spark producing device in a cylinder corresponding to the coil comprises the steps of: driving both primary windings of the coils of the cylinder pairs substantially simultaneously when one of the cylinders of the cylinder pairs is in compression to generate spark discharge energy in the secondary windings of the coils; monitoring the primary windings of the coils for signals representative of spark discharge in spark producing devices connected to the secondary windings; and, analyzing spark discharge signals on the primary windings to identify which cylinders of the cylinder pairs are in compression and which cylinders of the cylinder pairs are in exhaust.

The step of driving both primary windings of the coils of the cylinder pairs substantially simultaneously when one of the cylinders of the cylinder pairs is in compression to generate spark discharge energy in the secondary windings of the coils is continued at least until a cylinder pair including cylinder number one has been analyzed. For this embodiment of the invention, the method further comprises the steps of: tracking cylinder number one; discontinuing driving primary windings of cylinders of the cylinder pairs which are in exhaust upon the identification and tracking of cylinder number one; and, discontinuing analysis of the spark discharge signals.

The step of driving both primary windings of the coils of the cylinder pairs when one of the cylinders of the cylinder pairs is in compression to generate spark discharge energy in the secondary windings of the coils is continued at least until a cylinder pair including cylinder number one has been analyzed and the method further comprises the steps of: verifying the identification of cylinder number one as being in compression by analyzing the next cylinder pair following the cylinder pair including cylinder number one; tracking cylinder number one; discontinuing driving primary windings of cylinders of the cylinder pairs which are in exhaust upon the verification and tracking of cylinder number one; and, discontinuing analysis of the spark discharge signals.

Alternately, the step of driving both primary windings of the coils of the cylinder pairs when one of the cylinders of the cylinder pairs is in compression to generate spark discharge energy in the secondary windings of the coils is continued at least until a cylinder pair including cylinder number one has been analyzed and the method further comprises the steps of: verifying the identification of cylinder number one as being in compression by analyzing the cylinder pair including cylinder number one at least two times; tracking cylinder number one; discontinuing driving primary windings of cylinders of the cylinder pairs which are in exhaust upon the verification and tracking of cylinder number one; and, discontinuing analysis of the spark discharge signals.

In accordance with still another aspect of the present invention, a coil per plug ignition system for an internal combustion engine having an even number of cylinders divided into one or more cylinder pairs, each coil having a primary winding and a secondary winding with the secondary winding being connected to a spark producing device in a cylinder corresponding to the coil comprises first circuit means for driving the primary windings with dwell signals to produce spark discharges at spark producing devices connected to the secondary windings. The first circuit means is operable for driving substantially simultaneously primary windings of both coils of the one or more cylinder pairs of the internal combustion engine. Sensor means is coupled to the primary windings of the coils for generating primary signals representative of operation of the coils in response to the dwell signals. Second circuit means provide for analyzing the primary signals on the primary windings to identify which cylinder of the one or more cylinder pairs is in compression and which cylinder of the one or more cylinder pairs is in exhaust. Preferably, the second circuit means comprises a microprocessor.

In one embodiment of the present invention, the primary signals are representative of voltages across the primary windings and the second circuit means provides for comparing the duration times of the primary signals to identify which cylinders of the cylinder pairs are in compression. In an alternate preferred embodiment, the first circuit means drives the primary windings with at least first and second dwell signals for each spark event. The primary signals are representative of currents flowing in the primary windings. The second circuit means provides for determining dwell times required for the currents in the primary windings to reach a predetermined current level and for comparing the dwell times to identify which cylinders of the cylinder pairs are in compression.

It is thus a feature of the present invention to identify which cylinder of a cylinder pair is in compression and which cylinder of the pair is in exhaust by analyzing spark discharge signals monitored on the primary windings of ignition coils of a coil per plug (CPP) ignition system; to identify which cylinder of a cylinder pair is in compression and which cylinder of the pair is in exhaust by analyzing spark discharge signals monitored on the primary windings of ignition coils of a coil per plug (CPP) ignition system by comparing the duration times of spark discharge signals monitored on the primary windings of ignition coils of the cylinder pair; and, to identify which cylinder of a cylinder pair is in compression and which cylinder of the pair is in exhaust by analyzing spark discharge signals monitored on the primary windings of ignition coils of a coil per plug (CPP) ignition system by applying at least two dwell signals to the primary windings of ignition coils of the cylinder pair and comparing the times it takes for the second dwell signals to produce currents of a preselected magnitude in the primary windings.

Other features and advantages of the invention will be apparent from the following description, the accompanying drawings and the appended claims.

DETAILED DESCRIPTION OF THE INVENTION

Figure 1:
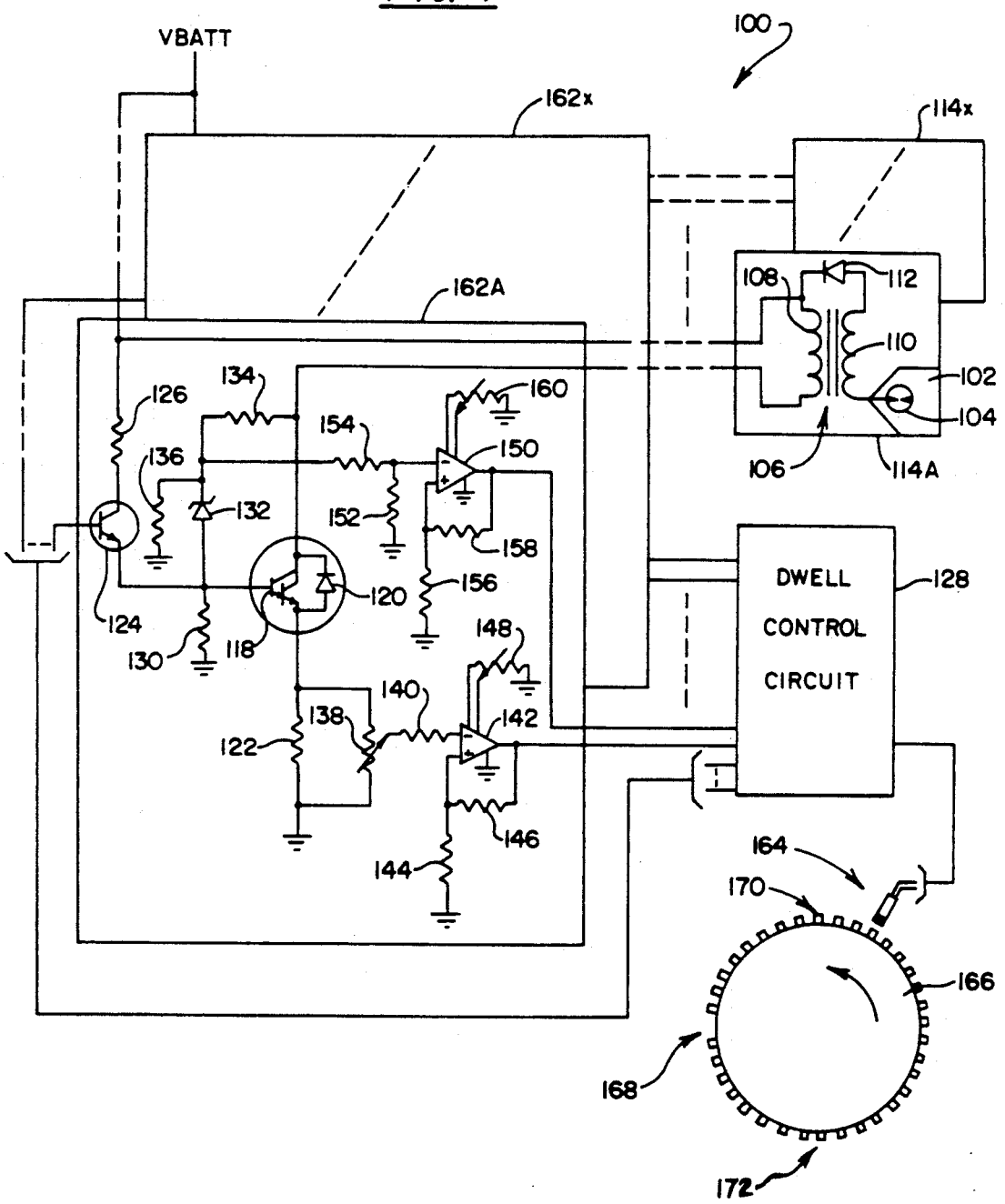
FIG. 1 is a schematic drawing of an ignition system operable in accordance with the present invention to perform cylinder identification by spark discharge analysis for internal combustion engines having an even number of cylinders and a coil per plug (CPP) ignition system.

Reference is now made to FIG. 1 which illustrates in schematic form a coil per plug (CPP) ignition system 100 for operating an internal combustion engine having an even number of cylinders with the cylinders organized into cylinder pairs. The CPP ignition system 100 illustrated will operate a two cylinder engine; however, it is noted that additional pairs of cylinders can be provided in accordance with the present invention for four, six, eight or more cylinder engines.

Structure and circuitry of the ignition system 100 for control of a single cylinder 102 will be described with the understanding that the structure and circuitry of the ignition system 100 is substantially the same for each of the cylinders of an engine. Each cylinder 102 includes a spark producing device, typically a spark plug 104, therein and a coil 106 having a primary winding 108 and a secondary winding 110. The secondary winding 110 is connected to the spark plug 104 and to a battery, VBATT, through a diode 112. Associated with each cylinder is the structure and circuitry shown in one of the boxes 114A–114X which are identical to one another with 114A representing the first cylinder and 114X representing the last cylinder cf an engine having an even number of cylinders which are arranged as cylinder pairs in the engine.

The primary winding 108 is connected in series with the battery, VBATT, the parallel combination of a Darlington driver 118 and an internal protection diode 120, and a current sense resistor 122. A base input of the Darlington driver 118 is connected to the battery, VBATT, through the series combination of a collector/emitter circuit of a transistor 124 and a collector resistor 126. A dwell signal is supplied to a base input of the transistor 124 to drive the primary 104 and thereby generate spark discharge energy in a secondary circuit including the secondary winding 110 and the spark plug 104.

The dwell signal is generated by a dwell control circuit 128 which comprises or includes a processor, typically a microprocessor, to control the dwell signals provided to the transistor 124 and like transistors of the other cylinders. The dwell control circuit 128 also controls the operation of the present invention as will be apparent. The base of the Darlington driver 118 is coupled to ground through a resistor 130 and to its collector through the series combination of a Zener diode 132 and a resistor 134. The node between the diode 132 and the resistor 134 is coupled to ground through a resistor 136. An adjustable trim resistor 138 is coupled in parallel with the current sense resistor 122 with an adjustable pickup terminal connected from the trim resistor 138 through an input resistor 140 to the negative input of a current sensing comparator 142.

The positive input of the comparator 142 is coupled to ground through a resistor 144 with the output of the comparator 142 being coupled back to the positive input of the comparator 142 through a feedback resistor 146. An offset adjustment resistor 148 connects the comparator 142 to ground with the output of the comparator 142 generating signals representative of whether the associated cylinder 102 is in a compression cycle, in compression, or in an exhaust cycle, in exhaust, in one embodiment of the present invention.

The negative input of a voltage sensing comparator 150 is connected to ground through a resistor 152 and to the primary 104 of the coil 102 through a series connection of a resistor 154 and the resistor 134. The positive input of the comparator 150 is coupled to ground through a resistor 156 with the output of the comparator 150 being coupled back to the positive input of the comparator 150 through a feedback resistor 158. An offset adjustment resistor 160 connects the comparator 150 to ground with the output of the comparator 150 indicating whether the associated cylinder 102 is in compression or in exhaust in an alternate embodiment of the present invention. The outputs of the comparators 142, 150 are connected to the dwell control circuit 128 for operation of the present invention. While both the comparator 142 and the comparator 150 may be provided in a single package for the sake of providing a single part for both embodiments of the present invention referred to above, it will be apparent that either one or the other can be provided alone dependent upon the embodiment and sensing operation selected for a given application.

Each cylinder control includes the circuitry shown in one of the boxes 162A–162X which are identical to one another with the box 162A corresponding to the first cylinder and the box 162X corresponding to the last cylinder of an engine having an even number of cylinders which are arranged as cylinder pairs in the engine. The ignition system 100 requires a crankshaft position sensor 164 and crankshaft mounted timing wheel 166. The sensor 164 and timing wheel 166, see FIG. 1, provide crankshaft angular position markers at 10° crankshaft intervals except for one interval marker 168 relative to the cylinder pair including cylinder No. 1. For 4 cylinder engines, the marker 168 identifies the 1–4 cylinder pair and is set at 90° before top dead center (BTDC), position marker 170 identifies 0° BTDC, and position marker 172 identifies 180° BTDC. The marker 168 or missing position marker is used to identify the location of cylinder pairs but does not resolve the ambiguity between compression and exhaust cycles.

In the past, a camshaft encoder or cylinder identification (CID) sensor which responds to indicia on a camshaft of the engine has been used for engine synchronization. Although a camshaft sensor can provide both cylinder identification and engine position, this application is undesirable since camshaft mounted timing wheels are a source of measurement inaccuracies caused by backlash between timing gears or other mechanical play in the camshaft drive system. The present invention permits the use of the crankshaft position sensor 164 alone by performing cylinder identification through spark energy release analysis. Accordingly, the present invention permits the elimination of the CID sensor or can permit proper engine operation for engines including CID sensors during periods of failure of the CID sensors.

Figure 2:
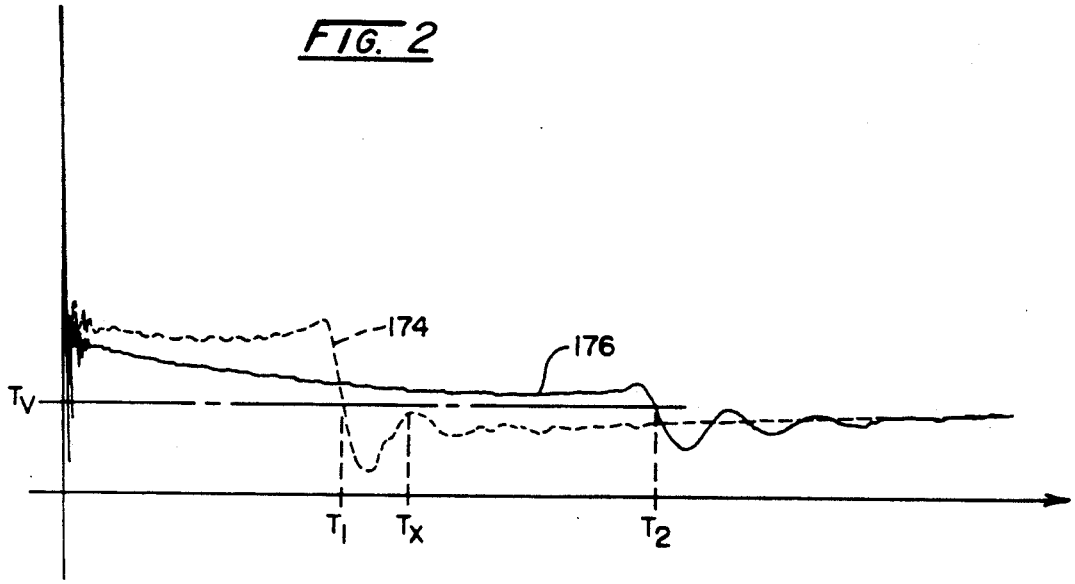
FIG. 2 is a graphic representation of primary coil voltages showing differences in the voltage waveform present when a spark is generated in a cylinder in compression of a cylinder pair and a cylinder in exhaust of a cylinder pair of the ignition system of FIG. 1.

Spark breakdown voltage is a function of cylinder pressure times spark gap distance such that a spark gap under compression will require a higher breakdown voltage, typically above 18 kilovolts, than a spark gap on an exhaust stroke, which will have a breakdown voltage typically below 4 kilovolts. The higher required breakdown voltage in a spark gap under compression results in a larger capacitive discharge component of energy being released quickly, leaving less energy to sustain the discharge. Conversely a spark under exhaust, due to the lower breakdown voltage, will result in a longer spark duration. FIG. 2 shows the differences in spark duration times for the two cases, $T_1$ for the dotted-line waveform 174 for a cylinder in compression and $T_2$ for the solid-line waveform 176 for a cylinder in exhaust. It is this difference in spark duration time or in the difference in coil energy remaining after a time $T_x$ which is utilized to identify the compression and exhaust cycles and ultimately establish cylinder identification.

In one embodiment of the present invention, cylinder identification is performed by substantially simultaneously applying dwell signals to cylinder pairs of the engine and comparing the duration times of the resulting spark discharge signals represented by the waveforms 174, 176 in FIG. 2 to one another. The shorter of the two spark discharge signals indicates the cylinder in compression and the longer of the two spark discharge signals indicates the cylinder in exhaust. As shown in FIG. 2, the spark discharge signal for the cylinder in compression represented by the waveform 174 has effectively terminated by the time $T_1$ while the spark discharge signal for the cylinder in exhaust represented by the waveform 176 does not terminate until the time $T_2$.

Since this embodiment of the present invention analyzes the voltage on the coil primary windings represented by the winding 108, the voltage comparators represented by the comparator 150 are required for its operation. The comparisons described are performed by the dwell control circuit 128 in response to output signals of the comparators 150 corresponding to the cylinder pairs which are identified via the crankshaft position sensor 164. The comparators 150 generate spark event signals representative of when the voltage levels of the spark discharge signals represented by the waveforms 174, 176 exceed a voltage threshold $T_v$ and thereby indicate the time duration of the spark events in the cylinders of the corresponding cylinder pair.

Figure 3:
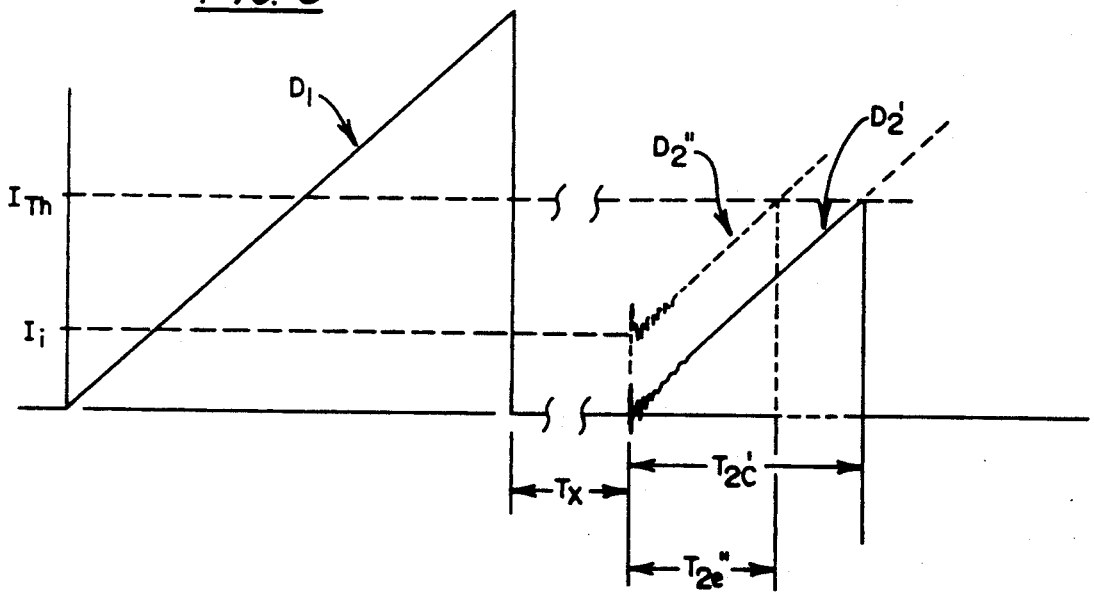
FIG. 3 is a graphic representation of primary coil current produced by the application cf multiple dwell signals to primary windings of coils of cylinder pairs and showing differences in the current waveform present for a cylinder in compression and a cylinder in exhaust.

While coil energy dissipation rates are inferred by measuring spark duration times in accordance with the embodiment just described, the high levels and quality of voltages present on the coil primaries 108 may tend to affect the reliability. Accordingly, the preferred method and apparatus of the present invention utilize multiple dwell signals wherein two or more dwell signals are applied to the primary windings represented by the primary winding 108 of cylinder pairs as is illustrated in FIG. 3. In FIG. 3, two dwell signals $D_1$ and $D_2$ are applied to the primary windings 108 of the coils 106 of cylinder pairs; however, it should be apparent that any reasonable number of dwell signals can be used in accordance with the present invention.

In the embodiment illustrated in FIG. 3, the second dwell signals $D_2$ are initiated after a fixed time delay $T_x$ following the first dwell signals $D_1$ and remain enabled at least until the coil currents reach a preselected magnitude $I_{Th}$. The fixed time delay $T_x$ between the first and second dwell signals $D_1$ and $D_2$ is set to be approximately equal to or greater than the spark duration time of a spark plug in a cylinder in compression as shown in FIG. 2. By applying the second dwell signals $D_2$ in this manner, the subsequent dwell times provide an indication of the amount of energy that has been expended in the preceding spark discharges, i.e. coil energy dissipation rates during the preceding spark events. With a spark gap in a cylinder in compression, the spark energy is substantially completely dissipated across the gap of the spark plug 104 during the time delay $T_x$.

If the second dwell signal $D_2'$ is applied at the end of this substantially completed spark event, very little if any energy is recovered from the coil 106. The initial low energy at the start of the second dwell signal $D_2'$ results in a near zero initial current flow which results in a time $T_{2c}'$ for the current in the primary winding 108 of the coil 106 to reach the preselected magnitude $I_{Th}$. Thus, the compression vs exhaust status of the cylinders of a cylinder pair is related to the charging times of the primary winding 108 in response to the second dwell signals $D_2$ from the time of application until the coil primary current has reached or exceeded the preselected magnitude $I_{Th}$ or current threshold.

With a spark gap in a cylinder in exhaust, the spark energy is not substantially completely dissipated across the gap of the spark plug 104 during the time delay $T_x$. When the second dwell signal $D_2$ is applied, the original spark is in the midst of the discharge with substantial coil energy still unexpended. This energy is recaptured at the start of the second dwell signal $D_2''$ and results in an instantaneous non-zero positive current flow $I_i$. This coil current offset permits the second dwell signal $D_2''$ to cause the current in the coil primary 108 to increase to the preselected magnitude $I_{Th}$ in a shorter time period $T_{2e}''$. Thus, by comparing the time periods $T_{2c}'$ and $T_{2e}''$ to one another, the dwell control circuit 128 is able to identify which cylinder of a cylinder pair is in compression and which cylinder of a cylinder pair is in exhaust.

Regardless of the ambiguity in terms of cylinder identification which initially exists, undelayed engine start-up is inherently performed in accordance with the present invention by initiating simultaneous sparks in cylinder pairs of the engine. One spark will fall during the compression cycle and result in combustion while the other spark will be wasted in an exhaust cycle. While such distributorless or simultaneous ignition systems are used in many internal combustion engines, the wasted spark in the cylinder in an exhaust cycle can disrupt engine operation for peak performance. A problem can be encountered, for example, in engines which use variable cam timing. Any potential problems are eliminated in the present invention by discontinuing simultaneous spark generation in cylinder pairs after cylinder identification, typically to identify cylinder No. 1, has been performed. Thus, an engine utilizing the present invention can be started using simultaneous ignition and then operated with sequential spark and/or sequential fuel injection without encountering the problems which may be encountered with continuous simultaneous spark ignition systems.

Figure 4:
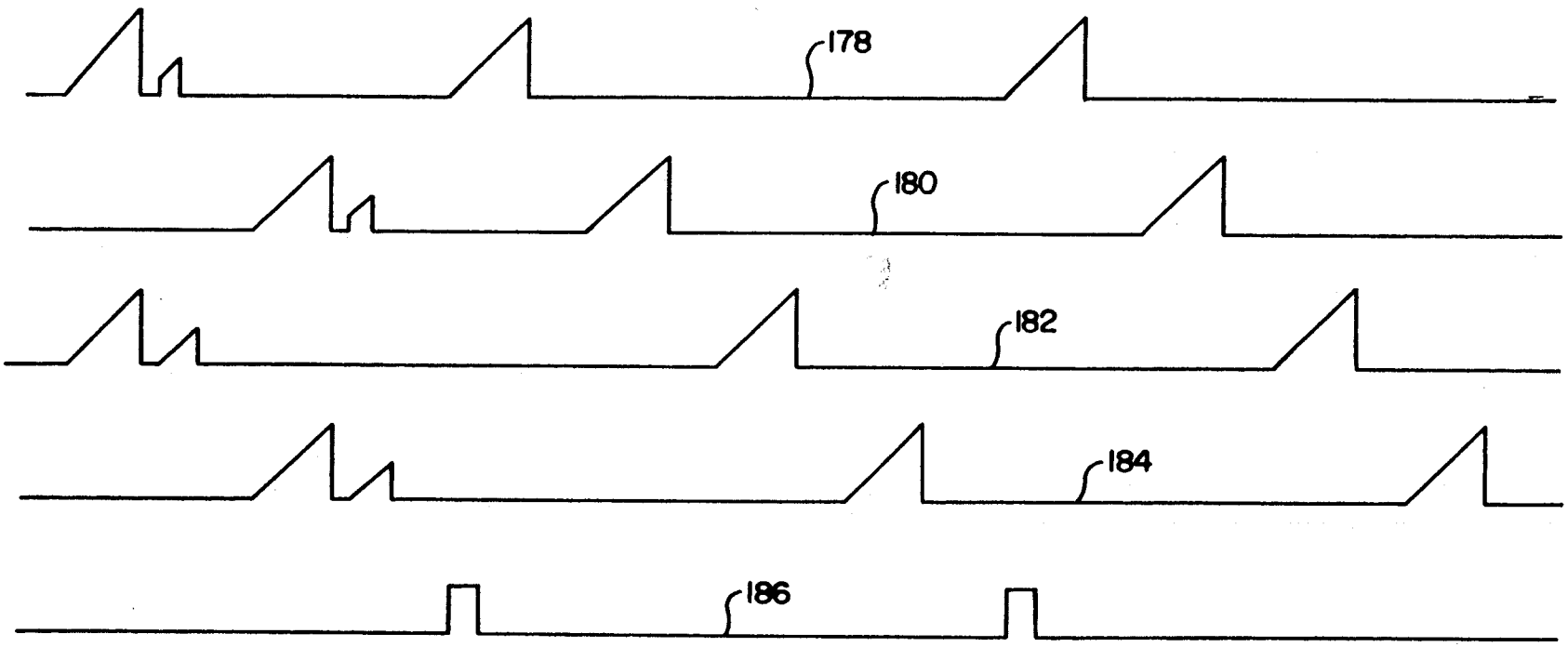
FIG. 4 graphically represents coil current waveforms at engine start-up and illustrates verification of cylinder identification in accordance with one arrangement of the present invention.

In the present invention, cylinder identification can be determined during the first spark event during engine crank or start-up. However, FIG. 4 illustrates coil current waveforms 178, 180, 182, 184 generated at start-up which utilize a second spark event for cylinder identification verification. As previously described, analysis of the waveforms 178, 180, 182, 184 results in the identification of cylinder No. 1 which is signaled by the waveform 186. Note that in this start-up sequence for a four cylinder engine, sparks are simultaneously generated in cylinders 1 and 4, the waveforms 178 and 182, and cylinders 3 and 2, the waveforms 180, 184. Also, dual dwell signals are utilized for analysis in accordance with the present invention as described with reference to FIG. 3.

Figure 5:
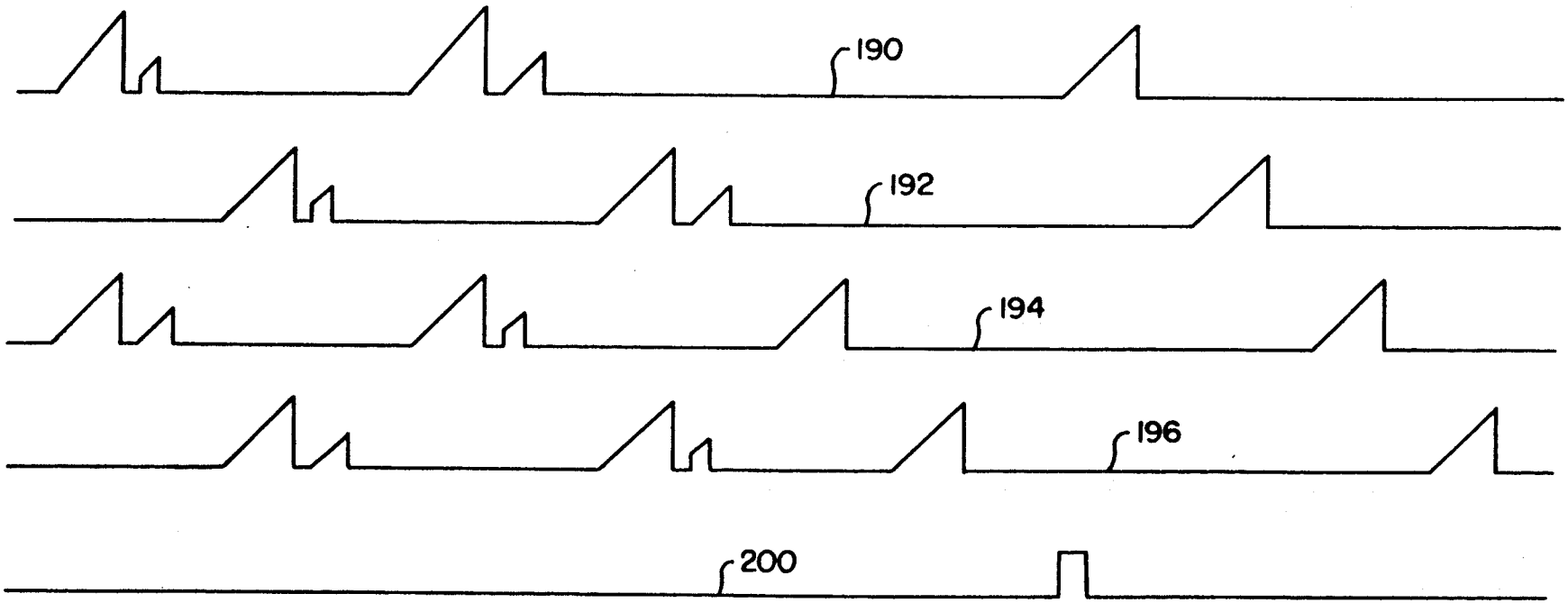
FIG. 5 graphically represents coil current waveforms at engine start-up and illustrates verification of cylinder identification in accordance with an alternate arrangement of the present invention.

The use of a verification technique is preferred because it eliminates errors due to differences in battery voltages; however, the verification technique illustrated in FIG. 4 is susceptible to errors caused by individual coil and cylinder variations. Accordingly, a preferred verification technique is illustrated in FIG. 5 wherein a second revolution of dual dwell signals are used to measure each cylinder under both compression and exhaust thereby eliminating sensitivity to cylinder to cylinder variations. In FIG. 5, the coil current waveforms 190, 192, 194, 196 generated at start-up for the second revolution verification technique are illustrated. As previously described, analysis of the waveforms 190, 192, 194, 196 results in the identification of cylinder No. 1 which is signaled by the waveform 200. Here again, in this start-up sequence, sparks are simultaneously generated in cylinders 1 and 4, the waveforms 190 and 194, and cylinders 3 and 2, the waveforms 192, 196. Also, dual dwell signals are utilized for analysis in accordance with the present invention as described with reference to FIG. 3.

Once cylinder identification is complete in accordance with the present invention, sequential spark and fuel strategies may be initiated. By internally tracking the firing sequence, i.e. cylinder No. 1, the ignition system is not required to generate simultaneous spark dwell signals during normal operating modes and enables cylinder identification through spark energy measurements to be completely transparent to the powertrain system. In the dual dwell illustrations of FIGS. 4 and 5 it is noted that the dual dwell operation is also terminated after cylinder identification. However, if desired, dual or other multiple dwell signals could continue to be provided for ignition purposes even though they would not be further required for cylinder identification. This is the case since the dwell control circuit 128 tracks the firing sequence, i.e. cylinder No. 1, once the cylinder identification of the present invention has been performed.

While it is believed that the methods of the present invention are apparent from the foregoing description, a description of the methods of the present invention for identifying a cylinder in compression of a cylinder pair in an internal combustion engine having an even number of cylinders and a coil per plug (CPP) ignition system will now be briefly described. In its broadest aspect, the method comprises the steps of: driving the primary windings 108 of the coils 106 of a pair of cylinders substantially simultaneously to generate spark discharge energy in the secondary windings 110 of the coils 106; monitoring the primary windings 108 for signals representative of spark discharge in spark producing devices, typically spark plugs 104, connected to the secondary windings 110; and, analyzing spark discharge signals on the primary windings 108 to identify which cylinder of the cylinder pair is in compression and which cylinder of the cylinder pair is in exhaust. Preferably the method further comprises the steps of: tracking the cylinder pair to maintain a record of which cylinder of the cylinder pair is in compression without further monitoring of the primary windings 108 and analysis of the spark discharge signals; discontinuing driving the cylinder of the cylinder pair which is in exhaust; and, discontinuing analysis of the spark discharge signals.

In one embodiment, the step of analyzing spark discharge signals on the primary windings 108 to identify which cylinder of the cylinder pair is in compression and which cylinder of the cylinder pair is in exhaust comprises the steps of: comparing the duration times of the spark discharge signals to one another; and, identifying a cylinder including the spark producing device which produced the shorter of the spark discharge signals as the cylinder of the cylinder pair which is in compression.

In another embodiment of the invention, the step of driving the primary windings 108 to generate spark discharge energy in the secondary windings 110 comprises the step of providing at least first and second drive signals or dwell signals $D_1$ and $D_2$ to the primary windings 108 for each spark event. In this embodiment, the step of analyzing spark discharge signals on the primary windings 108 to identify which cylinder of the cylinder pair is in compression and which cylinder of the cylinder pair is in exhaust comprises the steps of: stopping the second drive signals to the primary windings 110 when current flowing in the primary windings 108 reaches a preselected magnitude; determining time duration periods of the second drive signals to the primary windings 108; and, comparing the time duration periods of the second drive signals of the cylinder pair to one another.

Alternately, the step of analyzing spark discharge signals on the primary windings to identify which cylinder of the cylinder pair is in compression and which cylinder of the cylinder pair is in exhaust comprises the steps of: determining time duration periods of the second drive signals required to produce current flows in the primary windings 108 equal to a preselected magnitude; and, comparing the time duration periods of the second drive signals of the cylinder pairs to one another. Preferably in either event, the methods further comprise the step of indicating a cylinder having the longer dwell time duration period for its second drive signal as the cylinder in compression of the cylinder pair.

The methods may further comprise the steps of: verifying the identification of cylinder number one as being in compression by analyzing the next cylinder pair following the cylinder pair including cylinder number one; tracking cylinder number one; discontinuing driving primary windings of cylinders of the cylinder pairs which are in exhaust upon the verification and tracking of cylinder number one; and, discontinuing analysis of the spark discharge signals. For an alternate and preferred verification arrangement, the method further comprises the steps of: verifying the identification of cylinder number one as being in compression by analyzing the cylinder pair including cylinder number one at least two times; tracking cylinder number one; discontinuing driving primary windings of cylinders of the cylinder pairs which are in exhaust upon the verification and tracking of cylinder number one; and, discontinuing analysis of the spark discharge signals.

Having thus described the methods and apparatus of the present invention in detail and by reference to preferred embodiments thereof, it will be apparent that modifications and variations are possible without departing from the scope of the invention defined in the appended claims.

What is claimed is:

1. A method of identifying cylinders in compression of cylinder pairs in an internal combustion engine having an even number of cylinders and a coil per plug ignition system, each coil having a primary winding and a secondary winding with the secondary winding being connected to a spark producing device in a cylinder corresponding to said coil, said method comprising the steps of:

driving said primary windings of said coils of said pair of cylinders substantially simultaneously to generate spark discharge energy in said secondary windings of said coils;

monitoring said primary windings for signals representative of spark discharge in spark producing devices connected to said secondary windings; and analyzing spark discharge signals on said primary windings to identify which cylinder of said cylinder pair is in compression and which cylinder of said cylinder pair is in exhaust.

2. A method of identifying cylinders in compression of a cylinder pair in an internal combustion engine as claimed in claim 1 further comprising the steps of:

tracking said cylinder pair to maintain a record of which cylinder of said cylinder pair is in compression without further monitoring of said primary windings and analysis of said spark discharge signals;

discontinuing driving the cylinder of said cylinder pair which is in exhaust; and discontinuing analysis of said spark discharge signals.

3. A method of identifying a cylinder in compression of a cylinder pair in an internal combustion engine as claimed in claim 1 wherein the step of analyzing spark discharge signals on said primary windings to identify which cylinder of said cylinder pair is in compression and which cylinder of said cylinder pair is in exhaust comprises the steps of:

comparing the duration times of said spark discharge signals to one another; and identifying a cylinder including the spark producing device which produced the shorter of said spark discharge signals as the cylinder of said cylinder pair which is in compression.

4. A method of identifying a cylinder in compression of a cylinder pair in an internal combustion engine as claimed in claim 1 wherein the step of driving said primary windings to generate spark discharge energy in said secondary windings comprises the step of providing at least first and second drive signals to said primary windings for each spark event.

5. A method of identifying a cylinder in compression of a cylinder pair in an internal combustion engine as claimed in claim 4 wherein the step of analyzing spark discharge signals on said primary windings to identify which cylinder of said cylinder pair is in compression and which cylinder of said cylinder pair is in exhaust comprises the steps of:

stopping the second drive signals to said primary windings when current flowing in said primary windings reaches a preselected magnitude;

determining time duration periods of the second drive signals to said primary windings; and comparing the time duration periods of the second drive signals of said cylinder pair to one another.

6. A method of identifying a cylinder in compression of a cylinder pair in an internal combustion engine as claimed in claim 5 further comprising the step of indicating a cylinder having the longer time duration period for its second drive signal as the cylinder in compression of the cylinder pair.

7. A method of identifying a cylinder in compression of a cylinder pair in an internal combustion engine as claimed in claim 4 wherein the step of analyzing spark discharge signals on said primary windings to identify which cylinder of said cylinder pair is in compression and which cylinder of said cylinder pair is in exhaust comprises the steps of:

determining time duration periods of the second drive signals required to produce current flow in said primary winding equal to a preselected magnitude; and comparing the time duration periods of the second drive signals of said cylinder pair to one another.

8. A method of identifying a cylinder in compression of a cylinder pair in an internal combustion engine as claimed in claim 7 further comprising the step of indicating the cylinder having the longer time duration period of its second drive signal as the cylinder in compression of the cylinder pair.

9. A method of identifying cylinders in compression of cylinder pairs in an internal combustion engine having an even number of cylinders and a coil per plug ignition system, each coil having a primary winding and a secondary winding with the secondary winding being connected to a spark producing device in a cylinder corresponding to said coil, said method comprising the steps of:

driving both primary windings of said coils of said cylinder pairs substantially simultaneously when one of said cylinders of said cylinder pairs is in compression to generate spark discharge energy in said secondary windings of said coils;

monitoring said primary windings of said coils for signals representative of spark discharge in spark producing devices connected to said secondary windings; and analyzing spark discharge signals on said primary windings to identify which cylinders of said cylinder pairs are in compression and which cylinders of said cylinder pairs are in exhaust.

10. A method of identifying cylinders in compression of cylinder pairs in an internal combustion engine having an even number of cylinders and a coil per plug ignition system as claimed in claim 9 wherein the step of driving both primary windings of said coils of said cylinder pairs substantially simultaneously when one of said cylinders of said cylinder pairs is in compression to generate spark discharge energy in said secondary windings of said coils is continued at least until a cylinder pair including cylinder number one has been analyzed, said method further comprising the steps of:

tracking cylinder number one;

discontinuing driving primary windings of cylinders of said cylinder pairs which are in exhaust upon the identification and tracking of cylinder number one; and discontinuing analysis of said spark discharge signals.

11. A method of identifying cylinders in compression of cylinder pairs in an internal combustion engine having an even number of cylinders and a coil per plug ignition system as claimed in claim 9 wherein the step of driving both primary windings of said coils of said cylinder pairs when one of said cylinders of said cylinder pairs is in compression to generate spark discharge energy in said secondary windings of said coils is continued at least until a cylinder pair including cylinder number one has been analyzed, said method further comprising the steps of:

verifying the identification of cylinder number one as being in compression by analyzing the next cylinder pair following the cylinder pair including cylinder number one;

tracking cylinder number one;

discontinuing driving primary windings of cylinders of said cylinder pairs which are in exhaust upon the verification and tracking of cylinder number one; and discontinuing analysis of said spark discharge signals.

12. A method of identifying cylinders in compression of cylinder pairs in an internal combustion engine having an even number of cylinders and a coil per plug ignition system as claimed in claim 9 wherein the step of driving both primary windings of said coils of said cylinder pairs when one of said cylinders of said cylinder pairs is in compression to generate spark discharge energy in said secondary windings of said coils is continued at least until a cylinder pair including cylinder number one has been analyzed, said method further comprising the steps of:

verifying the identification of cylinder number one as being in compression by analyzing the cylinder pair including cylinder number one at least two times;

tracking cylinder number one;

discontinuing driving primary windings of cylinders of said cylinder pairs which are in exhaust upon the verification and tracking of cylinder number one; and discontinuing analysis of said spark discharge signals.

13. A coil per plug ignition system for an internal combustion engine having an even number of cylinders divided into at least one cylinder pair, each coil having a primary winding and a secondary winding with the secondary winding being connected to a spark producing device in a cylinder corresponding to said coil, said ignition system comprising:

first circuit means for driving said primary windings with dwell signals to produce spark discharges at spark producing devices connected to said secondary windings, said first circuit means being operable for driving substantially simultaneously primary windings of both coils of said at least one cylinder pair of said internal combustion engine;

sensor means coupled to said primary windings of said coils for generating primary signals representative of operation of said coils in response to said dwell signals; and second circuit means for analyzing said primary signals on said primary windings to identify which cylinder of said at least one cylinder pair is in compression and which cylinder of said at least one cylinder pair is in exhaust.

14. A coil per plug ignition system for an internal combustion engine having an even number of cylinders divided into at least one cylinder pair as claimed in claim 13 wherein said second circuit means comprises a microprocessor.

15. A coil per plug ignition system for an internal combustion engine having an even number of cylinders divided into at least one cylinder pair as claimed in claim 13 wherein said primary signals are representative of voltages across said primary windings and said second circuit means provides for comparing the duration times of said primary signals to identify which cylinder of said at least one cylinder pair is in compression.

16. A coil per plug ignition system for an internal combustion engine having an even number of cylinders divided into at least one cylinder pair as claimed in claim 13 wherein said first circuit means drives said primary windings with at least first and second dwell signals for each spark event, said primary signals are representative of current flows in said primary windings, said second circuit means provides for determining dwell times required for current in said primary windings to reach a predetermined current level and for comparing said dwell times to identify which cylinder of said at least one cylinder pair is in compression.

* * * * *

UNITED STATES PATENT AND TRADEMARK OFFICE

CERTIFICATE OF CORRECTION

PATENT NO. : 5,174,267

DATED : December 29, 1992

INVENTOR(S) : Charles J. DeBiasi

It is certified that error appears in the above-identified patent and that said Letters Patent is hereby corrected as shown below:

Column 11, line 65, "identifying cylinders" should be --identifying a cylinder--.

Column 11, line 66, "cylinder pairs" should be --a cylinder pair--.

Column 12, line 16, "identifying cylinders" should be --identifying a cylinder--.

Signed and Sealed this

Sixteenth Day of November, 1993

Bruce Lehman

*Attest:*

BRUCE LEHMAN

*Attesting Officer*

*Commissioner of Patents and Trademarks*